United States Patent [19]

Nasser

[11] Patent Number: 4,760,706

[45] Date of Patent: Aug. 2, 1988

[54] METHOD AND SYSTEM FOR CURRENT GENERATION

[76] Inventor: Gamal E. Nasser, Egenhofer Strasse 2, 8039, Puchheim, Fed. Rep. of Germany

[21] Appl. No.: 40,358

[22] Filed: Apr. 20, 1987

[30] Foreign Application Priority Data

Apr. 23, 1986 [DE] Fed. Rep. of Germany ..... 3613725

[51] Int. Cl.[4] ..... F01K 7/00

[52] U.S. Cl. ..... 60/675; 60/641.11; 60/649; 60/673; 60/676; 60/693

[58] Field of Search ..... 60/641.11, 648, 649, 60/651, 671, 673, 675, 676, 685, 689, 690, 693, 698

[56] References Cited

U.S. PATENT DOCUMENTS

| | | | |
|---|---|---|---|
| 3,953,971 | 5/1976 | Parker | 60/675 X |
| 4,192,145 | 3/1980 | Tanaka | 60/675 |
| 4,318,275 | 3/1982 | Brown et al. | 60/675 |

*Primary Examiner*—Stephen F. Husar
*Attorney, Agent, or Firm*—Krass & Young

[57] ABSTRACT

Method and system for generating electric power utilizing a coolant circuit, in which a coolant is evaporated at a lower level position, allowed to rise via tubing to a higher level position, liquified at the higher level position, and allowed to flow down to the lower level position in tubing where it impinges a hydraulic turbine connected to a generator. The preferred embodiment includes a vertical tube system of approximately 3000 m length, composed of a long tube for rising vapors and fall tubes for falling liquid coolant. Multiple cooling systems located at the higher level position, including a counterflow cooling system, forced-draught type air cooler, and a step-by-step cooling process, are utilized to liquify the coolant and provide working vapor to power the cooling systems. The coolant is composed to $C_3H_8$ and $NH_3$, which is varied on a percent composition basis to match atmospheric weather conditions.

31 Claims, 8 Drawing Sheets

METHOD AND SYSTEM FOR CURRENT GENERATION

BACKGROUND OF THE INVENTION

The invention relates to a method and a system for generating electric power with the aid of a coolant circuit.

In the hitherto known power stations the questions of fuel disposal, security problems, cost-benefit problems and environmental problems have been solved in non-satisfying manner. Thermal power stations are operated on basis of fossil fuels exclusively, such fuels being available in only limited extent and becoming more and more expensive. The burning of fossil fuels causes substantial environmental damages. Solar power stations cannot be operated in northern industrial states, are expensive in construction and cause considerable maintenance costs. Power stations making use of earth temperature only can reach a low output, wherein furthermore corrosion problems having not yet been solved occur which have neither been solved in the hitherto proposed ocean-temperature-slope power stations.

SUMMARY OF THE INVENTION

The present invention is based on the problem of creating a method for power generation, such method being inoffensive to the environment, causing comparatively low costs and being of high efficiency, the output obtained to be adaptable to the respective power demand in winter as well as in summer. Furthermore, a system for carrying out the method is to be disclosed, such system being capable of being built directly beside the consumers' network.

The method of the present invention discloses a coolant circuit in which liquid coolant is evaporated in a first lower level position, whereupon the coolant vapour rises to a second level position being at a substantially higher level, where the vapour is liquified by the considerably cooler vicinity and flows down to the first level position, wherein the liquid coolant impinges onto an hydraulic turbine wich is connected to a generator. Subsequently, the coolant again is fed to the evaporator. Thus in accordance with the present invention a combination of a gaseous and a liquid coolant is used for at first obtaining potential energy after the feeding of heat in the evaporator, of the coolant, which energy subsequently is convertred into kinetic energy. Therein it is essential that the temperature in the second level position is much more balanced and lower than the temperature of the first level position.

The liquid coolant is suitably evaporated in a heat exchanger being arranged approximately at the base of the plant. The heat exchanger may be arranged in the bed of a river so that the coolant is evaporated by heat being fed from the river water. This is also possible in winter as the water temperature does not sink below 5° C. A second heat exchanger may be provided which heats the coolant by means of waste heat of a neighbouring power plant or industrial plant or by means of solar or earthern heat for overheating.

Alternatively the liquid coolant may be evaporated in regions with respective climatic conditions in that warm humid air is led towards the coolant in a heat exchanger. If the method is carried out, e.g., at the coasts of the Arabic Gulf States, it is by this method possible to additionally obtain fresh water out of the damp air having cooled down and furthermore the climate can be improved by the dry air having cooled down. For this purpose the evaporator suitably is arranged at a height of appx. 30 m above the ground.

The overheated coolant vapour subsequently rises to an extreme height, the vapour experiencing an adiabatic expansion against gravity and cooling down continuously. Therein the coolant vapour rises in a tube carrying the means for liquifying the coolant in the second level position. When the coolant vapour reaches the second level position it has already cooled down by some degrees, but still has not reached the saturation limit.

It is suitable to cool down the vapour—primarily—in a counterflow cooling system up to a value near the saturation limit, before the vapour is liquified in a forced-draught air cooler. Subsequently a pump may bring the condensate to a higher pressure level prior to its entry into the counterflow cooling system and to being heated there with a simultaneous cooling down of the coolant vapour. Subsequently the liquid coolant can be cooled down in steps in containers intended for such purpose, wherein the working steam developing therein can be used for turbines driving ventilators for the forced-draught-type air cooler.

The coolant cooled down in such a way finally arrives at fall tubes again leading back to the first level position. Therein in each fall tube continuously a liquid column is formed being as high as the tube. At the base of each fall tube an hydraulic turbine is arranged, which turbine is connected to a generator.

The method according to the present invention can be carried out during the cold season as well as during the warm season, the coolant preferably being adapted to the different temperature conditions. It is proposed as being very advantageous to use a mixture of $C_3H_8$ and $NH_3$ as coolant, wherein in the cold season $NH_3$ is eliminated from the circulation so that in this time the systems is operated with $C_3H_8$ only. In summer $C_3H_8$ is eliminated and the method is carried out using $NH_3$ as coolant. It is also possible to take account of the climatic conditions in selecting a suitable coolant.

The method in accordance with the present invention has the advantage that no fossil fuels are consumed and that it is extremely inoffensive to the environment. If the evaporator is disposed in a river bed, heat is extracted from the river water, whereby the living conditions in the water, generally being highly stressed by a substantial amount of waste heat, in industrial countries are improved. The operating costs for carrying out the method are minimal and the output obtained always can be adapted to the power demand.

For energy generation hydraulic turbines are used being considerably less expensive, more compact and practically maintenance-free as compared to the commonly used steam turbines. Moreover, the hydraulic turbines work with a considerably higher efficiency.

If a system being operated in accordance with the method of the invention is combined with a traditional power station, it is in addition possible to do without cooling towers which come to about 10% of the total costs of the traditional power stations and require almost one half of the total construction site.

The system according to the present invention, for generating electric current shows a long tube being essentially arranged perpendiculary and preferably reaching up to a height of 3000 m, with a diameter of preferably approximately 20 m, in which tube said coolant vapour rises. Said tube is surrounded by fall tubes of smaller diameters, in which tubes the coolant having been liquified on a upper platform again flows down to the first level position.

It is possible to safely anchor the tube structure which may be made of aluminium by means of a plurality of pull ropes, preferably fibre-glass-reinforced or carbon-fibre-reinforced plastic ropes.

On the platform being arranged in the region of the upper end of the tube structure the means for liquifying the rising coolant vapour are arranged. As the air cooler or coolers, respectively, are disposed in great height, where the speed of air is much higher than it is near the ground, a very high amount of wind energy is at disposal for cooling purposes. It is advantageous to additionally provide a dynamic pressure wall in the region of the upper platform, which wall is mounted pivotally and is held in wind direction by means of a fin, whereby an additional dynamic pressure is created at the condenser blocks, said pressure amplifying the cooling effect of the fans provided for, too.

The air coolers are of great importance for the efficiency of the method according to the present invention. As only a very limited amount of temperature difference exists between evaporation and condensation, it is necessary to keep the condensation temperature as low as possible. At the same time it is not possible that the area of attack is enlarged to any desired extent. This problem can only be solved satisfactorily when very large amounts of air per $m^2$ of area of attack flow at the downstream face, while at the same time a large heating surface per $m^2$ of area of attack is available. This results in an increased pressure drop which is however limited by the driving output of the fans. As this problem cannot be solved when using traditional coolers with ribbed pipes, it is proposed in accordance with the present invention to use air coolers with wave surfaces as they are shown in the DE-OS No. 32 39 816. De-OS No. 32 39 816 is a German Patent Application which was published on Dec. 1, 1983. The Official Ser. No. is No. P 32 19 387.4 Such wave-surface air coolers provide the advantage that only appx. 1/5 of the area of attack of a ribbed-pipe cooler are required at a pressure drop of 30 mmWS (mm water head). Using the wave-surface air coolers provided in accordance with the invention the condensation of the coolant on the platform of the tube structure can be carried out without difficulties.

The system according to the present invention may also be erected at northern coasts. In such cases sea water is used as evaporation substance. Such systems may be designed for very large amounts of power output.

Systems being design for smaller power output can also be erected at the foot of high mountains, the air cooler being installed in the reagion of the summit of the mountain.

The system according to the present invention may in advantageous manner be combined with an already existing power station for heating the coolant vapour to a respective temperature. The superheating may, however, also be effected by means of earth temperature, solar collectors or waste heat of industrial plants.

LIST OF DIFFERENT VIEWS OF THE FIGURES

Further features, advantages and details of the present invention can be seen from the following description as well as from the drawings.

DETAILED ACCOUNT OF THE PREFERRED EMBODIMENT OF THE INVENTION

Figure 1:
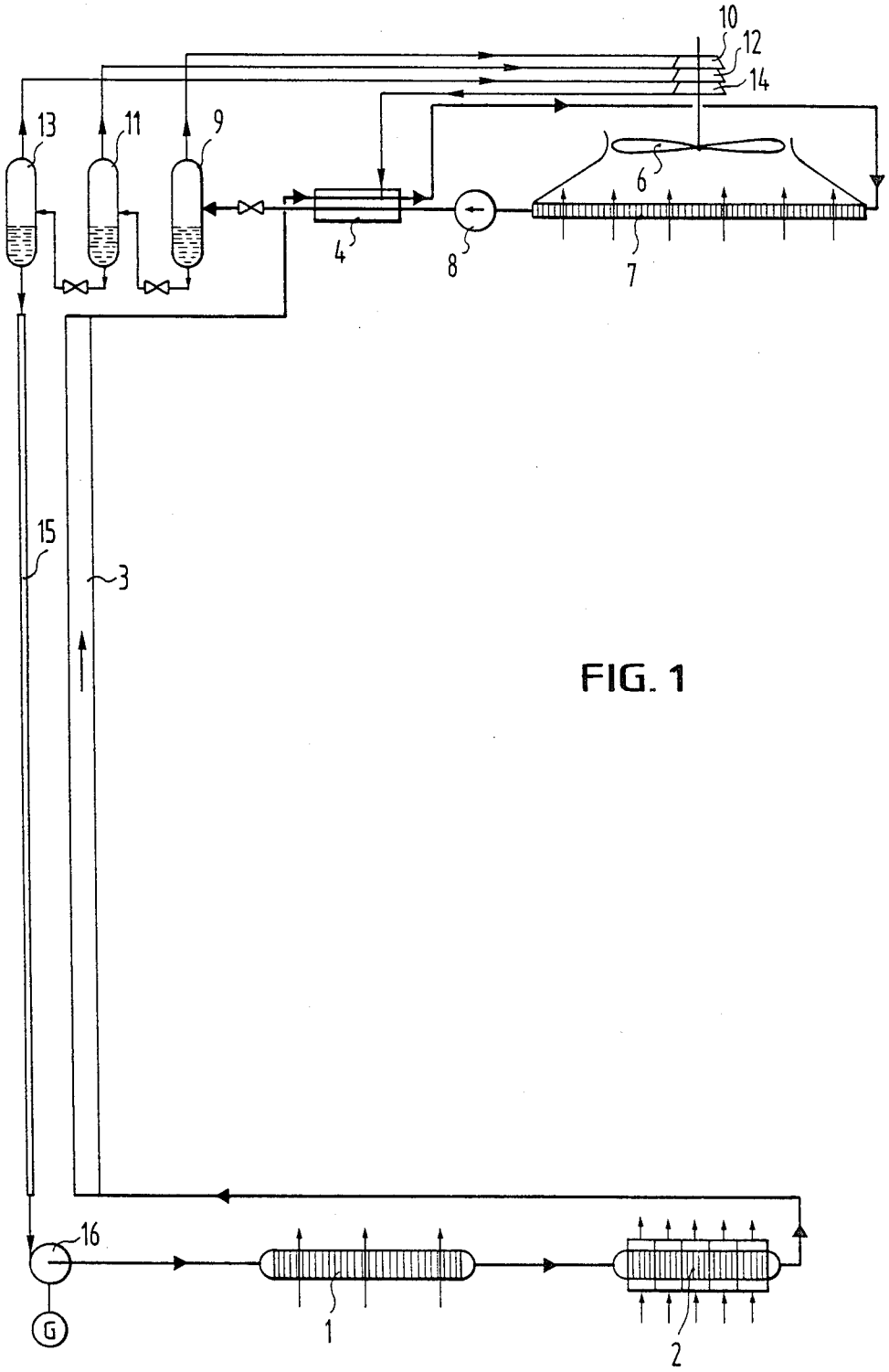
FIG. 1 is a diagram for showing the method according to the present invention.

At first reference is made to FIG. 1. By means of a first heat exchanger 1 river water is led towards a coolant, wherein the coolant is evaporated and the river water is cooled down. In a second heat exchanger 2 the coolant vapour is further heated by condensation of the exhaust steam discharge from the turbine of a neighbouring power station, by several degrees. The superheated coolant vapour subsequently rises in a vertical tube 3 to a height of appx. 3000 m. When arriving at the end of the tube the coolant vapour has already cooled down by several degrees, is—however—not yet saturated.

In a counterflow cooling system 4 the vapour is cooled down up to close to the saturation limit.

Subsequently the coolant vapour enters an air cooler 7 being connected with a fan 6, in which cooler the vapour is liquified. A pump 8 subsequently brings the condensate to a higher pressure level before it is led through the counterflow system 4. In containers 9, 11 and 13 the liquid cools down further step by step. Therein working steam is set free for the turbines 10, 12 and 14 driving the fan 6.

Then the liquid leaves the container 13 in a condition prevailing also in the evaporator 1. In a fall tube 15 the liquid coolant flows down to a turbine 16 which is connected to a generator G. Then the coolant again reaches its initial state at the heat exchanger 1.

Figure 2:
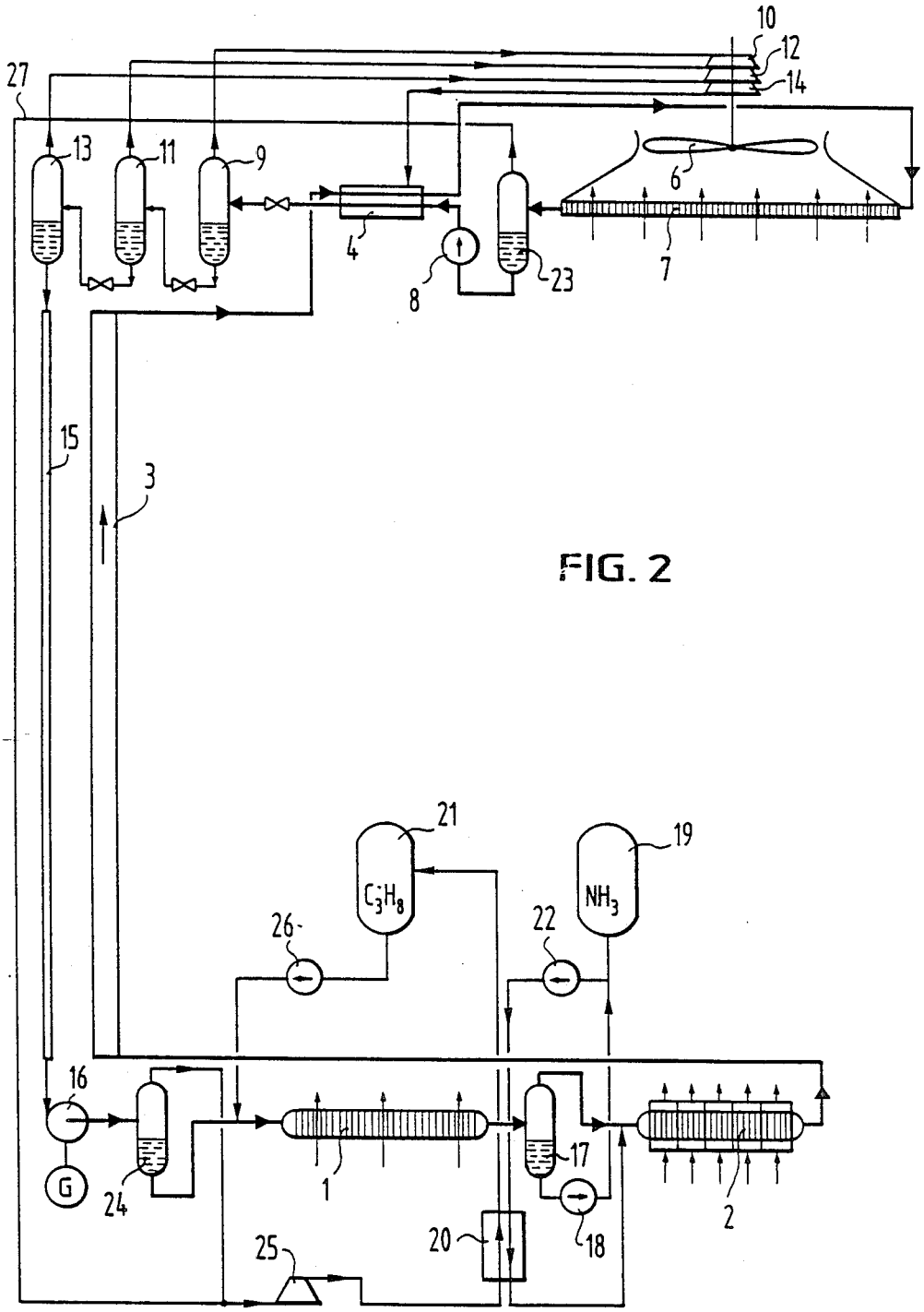
FIG. 2 is a view according to FIG. 1 with additional means for adapting the method of the invention to different temperature conditions.
Figure 3:
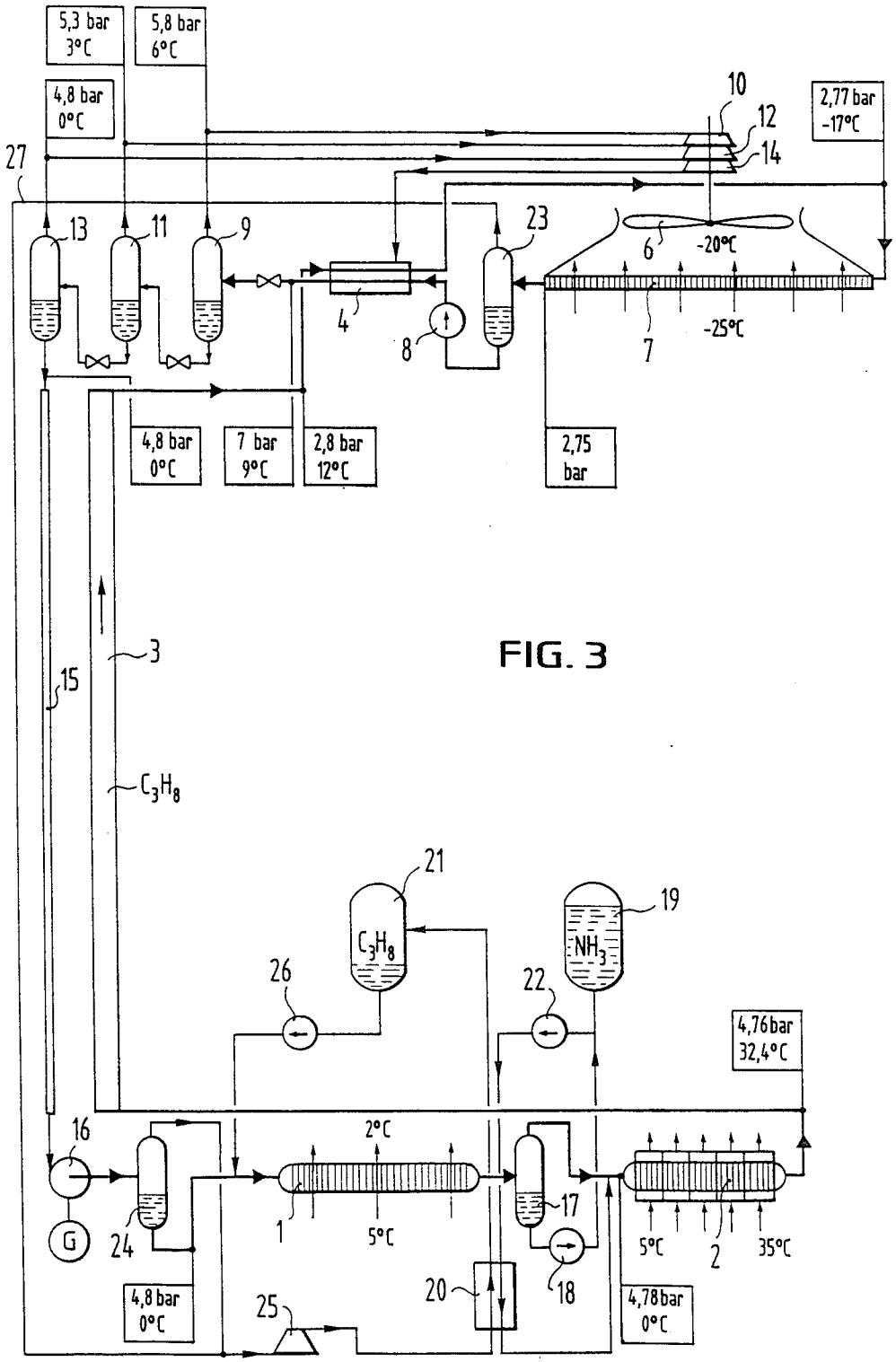
FIG. 3 is the method according to the present invention during operation in winter with indications of pressure and temperature.
Figure 4:
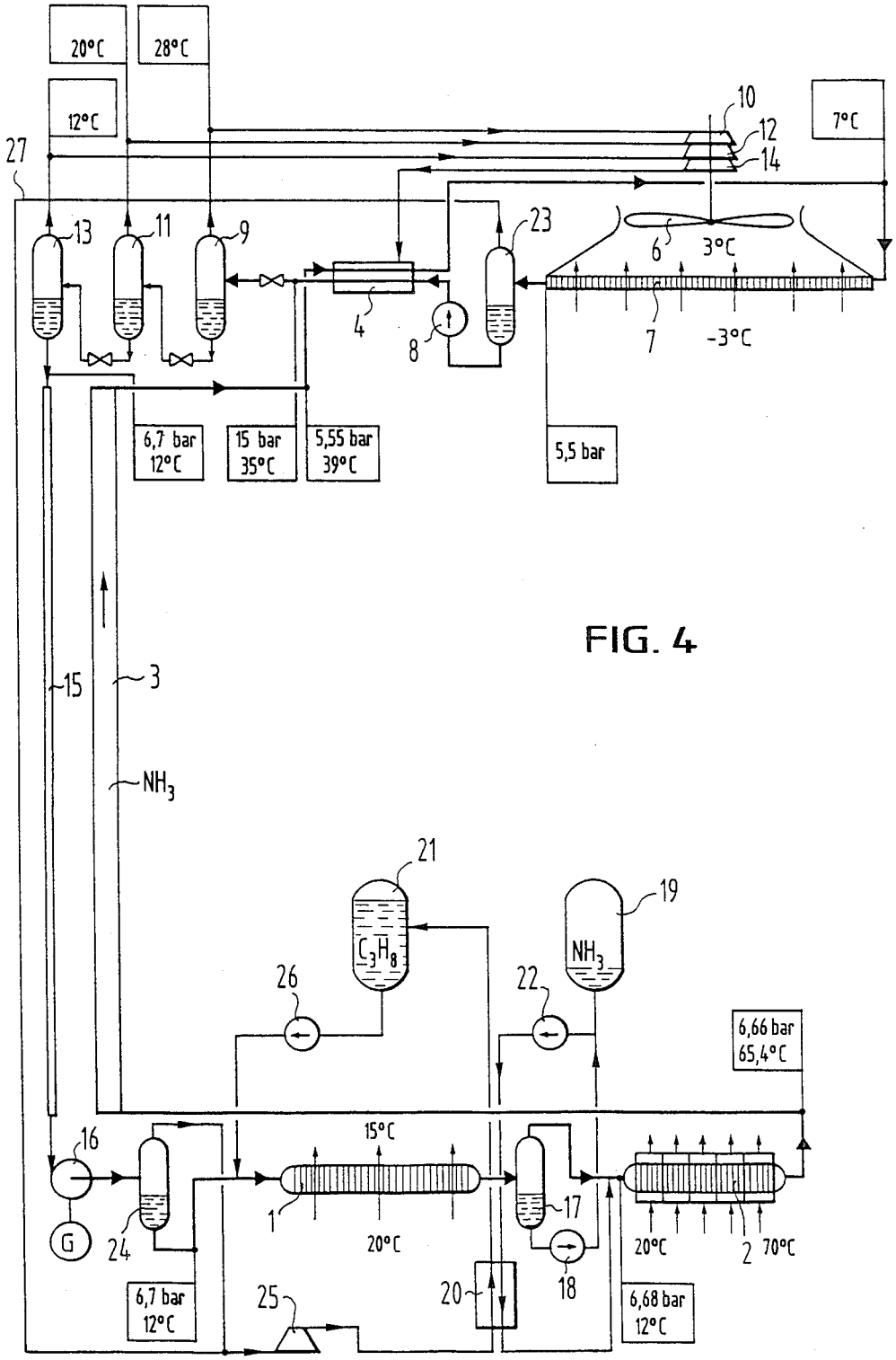
FIG. 4 shows the method according to the present invention during operation in summer with indications of pressure and temperature.

FIG. 2 reveals means with which a coolant mixture out of $C_3H_8$ and $NH_3$ can be adapted to the different temperature conditions during operation in winter and summer. The system shown in FIG. 3 is operated with $C_3H_8$, whereas the system according to FIG. 4 uses as coolant $NH_3$ exclusively.

Figure 7:
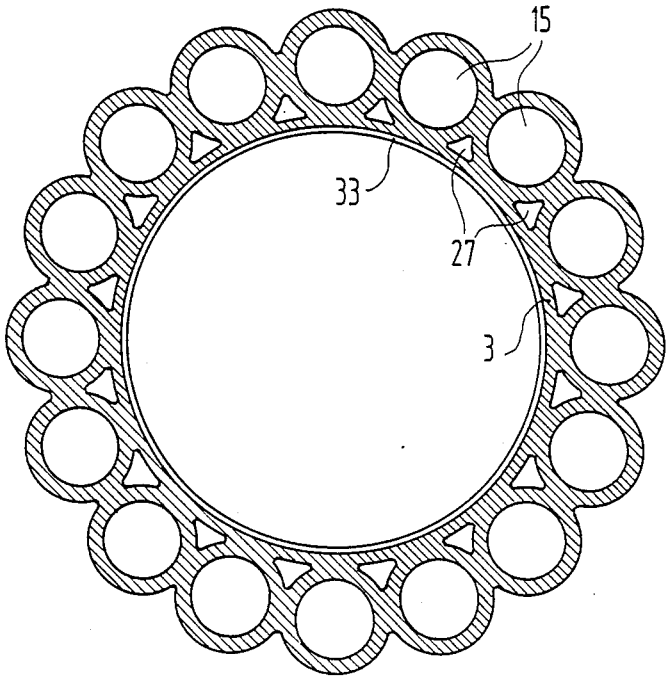
FIG. 7 is a horizontal section through the tube structure.

During the time of transition between winter and summer part of $C_3H_8$ in the air cooler 7 does not condensate and enters a container 23 in the form of vapour. Said share of vapour is fed to a compressor 25 through tubes 27 (FIG. 7). By the compression and the subsequent cooling down in a combined evaporator/condenser 20 the $C_3H_8$-vapour is liquified and emerges into a storage reservoir 21. The liquefaction heat in the combined evaporator/condenser 20 simultaneously evaporates a liquid fraction out of a $NH_3$-reservoir 19 which fraction is brought into the circulation prior to the evaporator 2.

In the time of transition between summer and winter part of the $NH_3$ in the evaporator 1 does not vaporize and enters a container 17 and from there is led to a storage reservoir 19 via a pump 18. Instead, a liquid fraction from the reservoir 21 is supplied to the circuit by the pump 26 prior to the heat exchanger 1.

Figure 5:
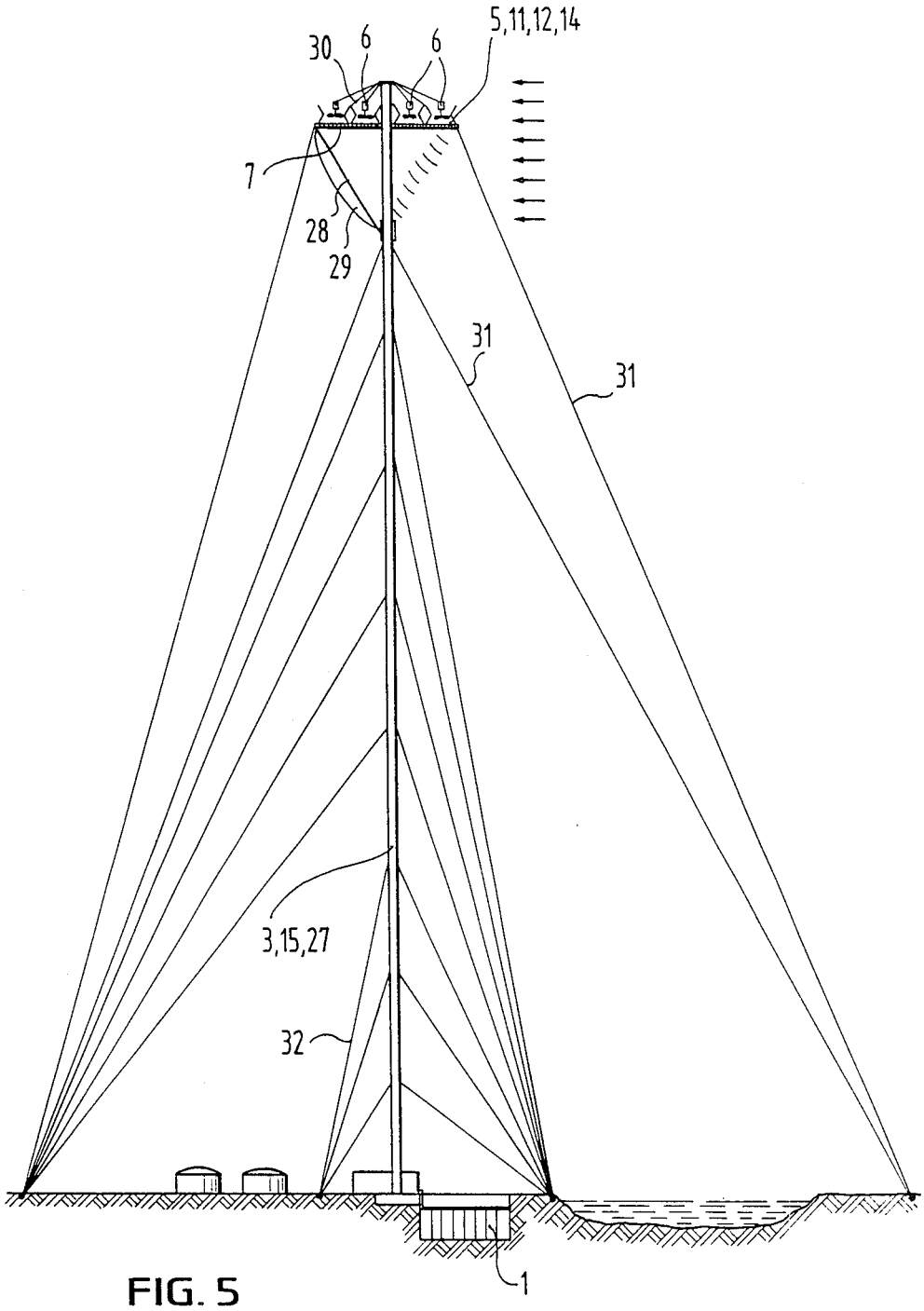
FIG. 5 is a schematic side view of a system in accordance with the present invention, for generating electric power.
Figure 6:
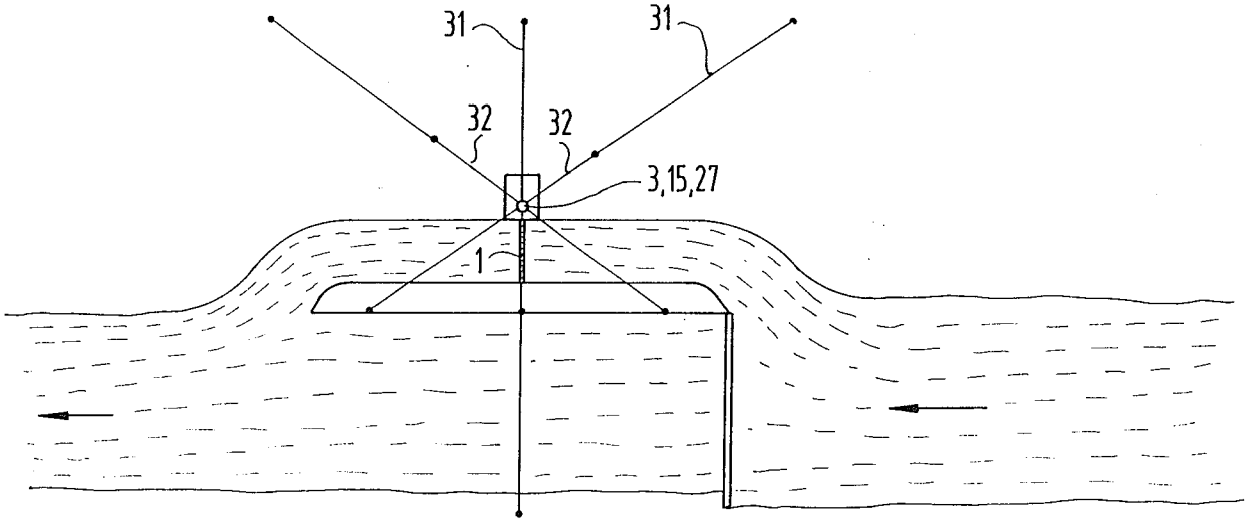
FIG. 6 is a schematic top view of the system according to FIG. 5.

In very schematic manner FIGS. 5 and 6 show a side view and a top view of an embodiment of the system according to the present invention, being built at the shore of a river. At the upper end of the tube structure 3, 15, 27 (FIG. 7) a platform 5 is secured with ropes 30, which is held in position—as is the tube structure—by steel ropes 31, 32 which are anchored in the gound. An evaporator 1 is mounted in a side channel of the river bed and is flown through by the river water, whereby the coolant vaporizes in the heat exchanger.

Below the platform 5 carrying the means 4 to 14 for cooling down and liquifying the coolant a dynamic pressure wall 28 is pivotally fixed in suitable manner, which wall is always held in wind direction by means of a fin 29 and which creates additional dynamic pressure at the interchange blocks.

FIG. 7 shows the tube structure out of a central tube 3 having a diameter of about 20 m, in which the coolant vapour rises to the second level position of the system, which level position is at about 3000 m above the base of the system. The central tube 3 is surrounded by a plurality of fall tubes 15 having a considerably smaller diameter. Between the fall tubes 15 and the central tube 3 tubings 27 are arranged, in which—if required non-liquified coolant vapour can be led back to the first level position, i.e. to the base of the system. The tube structure of the tubes 3 and 15 is cast stepwise in one piece and is provided with an insulating layer 33 on the inner surface.

Figure 8:
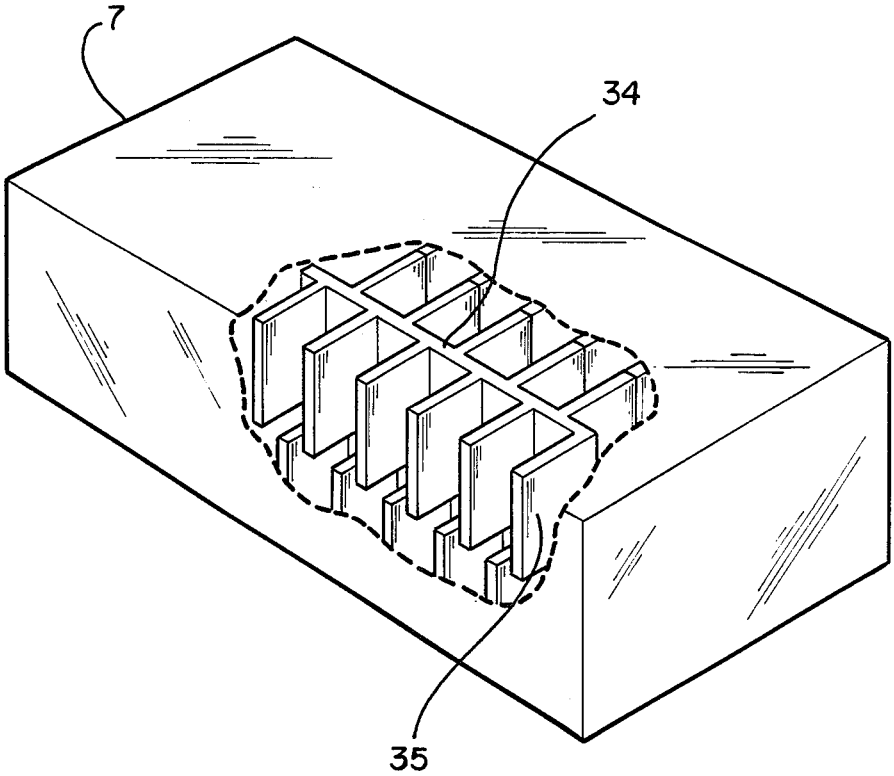
FIG. 8 is a cut-away perspective view of an air cooler of the wave-surface type.

FIG. 8 shows an air cooler in block diagram. The pertinent portion of the diagram being illustrative of a wave surface type air cooler. This type of air cooler has heat exchanger plates 34 with reinforcing projections 35 formed in the longitudinal and transverse directions of the plate 34. The projections are arranged so that a projection on one side corresponds to a recess on the other side. The units are stacked offset with grooves between into pairs. Then the pairs are stacked against each other in mirror symmetry. In this manner tubular ducts are formed by the junction of the projections, while slot-like ducts are formed through the grooves in connecting the units. In this manner the heat exchanging media pass in a cross-flow pattern.

In the following two examples for a calculation of the output of the system according to the present invention, for being operated in winter and/or in summer, respectively, will be described (FIGS. 2 and 3).

EXAMPLE

OPERATION OF SYSTEM IN WINTER

The following presuppositions are made:

Amount of water passing through the heat exchanger 1: 1000 $m^3/s$. When the above amount of water passes through the heat exchanger 1 a cooling of flow of 5−2=3K of the river water is effected.

Therefrom the quantity of heat $Q_L$ is calculated as follows:

$$Q_L = 1000 \times 1000 \times 3 \times 1.163 \times 3600 \times 10^{-6} = 12560 \text{ MW}$$

The coolant $C_3H_8$ is evaporated by the heat quantity $Q_L$ and the amount of $C_3H_8$ evaporated is calculated as follows:

$$\text{Amount of } C_3H_8 = \frac{12560 \times 4 \times 10^6}{370 \times 10^3} = 33947 \text{ kg/s}$$

It is further assumed that in addition waste heat from an existing power station of 2000 MW is fed to the heat exchanger 2 in order to superheat the coolant in the heat exchanger and the superheating is as follows:

$$\text{Superheating} = \frac{2000 \times 10^6}{1820 \times 33947} = 32.4 \text{ K.}$$

The coolant having been pre-evaporized and superheated in such manner is detensioned when it rises in the mast 3 as follows:

$$\frac{dT}{dH} = \frac{g}{R} \times \frac{n-1}{n} \text{ [K/m]} = \frac{9.8067}{186.05} \times \frac{1.15-1}{1.15} = 0.00687 \text{ [K/m]}$$

wherein dT/dH = temperature difference per height difference g = constant of gravitation R = gas constant n = cp/cv (gas constant).

From the previous equation a temperature difference between the first level position ($T_u$) and the second level position ($T_o$) results as follows:

$$T_u - T_o = 0.00687 \times 3000 = 20.6 \text{ K.}$$

During its passage through the tube 3 the coolant experiences an adiabatic expansion, the pressure drop being calculated as follows:

$$\frac{P_u}{P_o} = \left(\frac{T_u}{T_o}\right)^{\frac{n}{n-1}} = \left(\frac{305.4}{295}\right)^{\frac{1.15}{0.15}} = 1.6989$$

wherein $P_u$ = pressure in the lower level position $P_o$ = pressure in the upper level position.

With a pressure of 4.76 bar in the lower level position ($P_u$) $P_o$ is calculated as follows:

$$P_o = \frac{4.76}{1.6989} = 2.8 \text{ bar}$$

The output of the hydraulic turbine is calculated as follows:

$$L_T = \frac{C_3H_8\text{-amount} \times \text{tube length} \times \text{efficiency}}{\text{conversion factor to MW}} = \frac{33947 \times 3000 \times 0.95}{102 \times 1000} = 948.5 \text{ MW}$$

wherein $L_t$=output of the hydraulic turbine.

EXAMPLE

OPERATION OF SYSTEM IN SUMMER

The following presuppositions are made:

Amount of water passing through the heat exchanger 1: 1000 $m^3/s$. When the above amount of water passes through the heat exchanger 1 a cooling of flow of 30−25=5K of the river water is effected.

Therefrom the quantity of heat $Q_L$ is calculated as follows:

$$Q_L = 1000 \times 1000 \times 5 \times 1.163 \times 3600 \times 10^{-6} = 20934 \text{ MW}$$

The coolant $NH_3$ is evaporated by the heat quantity $Q_L$ and the amount of $NH_3$ evaporated is calculated as follows:

$$\text{Amount of } NH_3 = \frac{20934 \times 10^6}{1200 \times 10^3} = 17445 \text{ kg/s}$$

It is further assumed that in addition waste heat from an existing power station of 2000 MW is fed to the heat exchanger 2 in order to superheat the coolant in the heat exchanger and the superheating is as follows:

$$\text{Superheating} = \frac{2000 \times 10^6}{2147 \times 17445} = 53.4 \text{ K.}$$

The coolant having been pre-evaporized and superheated in such manner is detensioned when it rises in the mast 3 as follows:

$$\frac{dT}{dH} = \frac{g}{R} \times \frac{n-1}{n} \text{ [K/m]} = \frac{9.8067}{481.68} \times \frac{1.313-1}{1.313} = -0.00485 \text{ [K/m]}$$

wherein dT/dH=temperature difference per heigt difference g=constant of gravitation R=gas constant n=cv/cp (gas constant).

From the previous equation a temperature difference between the first level position ($T_u$) and the second level position ($T_o$) results as follows:

$$T_u - T_o = 0.00485 \times 3000 = 14.5 \text{ K.}$$

During its passage through the tube 3 the coolant experiences an adiabatic expansion, the pressure drop being calculated as follows:

$$\frac{P_u}{P_o} = \left(\frac{T_u}{T_o}\right)^{\frac{n}{n-1}} = \left(\frac{338.4}{323.9}\right)^{\frac{1.3}{0.3}} = 1.2$$

wherein $P_u$=*pressure in the lower level position*

$P_o$=pressure in the upper level position.

With a pressure of 6.66 bar in the lower level position ($P_u$) $P_o$ is calculated as follows:

$$P_o = \frac{6.66}{1.2} = 5.55 \text{ bar}$$

The output of the hydraulic turbine is calculated as follows:

$$L_T = \frac{NH_3\text{-amount} \times \text{tube length} \times \text{efficiency}}{\text{conversion factor to MW}} = \frac{17445 \times 3000 \times 0.95}{102 \times 1000} = 487.4 \text{ MW}$$

wherein $L_t$=output of the hydraulic turbine.

The output values for the system calculated in the examples lie within the scope/range of large-scale nuclear power stations.

What is claimed is:

1. A method for power generation utilizing a coolant circuit comprising:

(A) evaporating a liquid coolant into a coolant vapor at a first level position;

(B) causing said coolant vapor to rise to a second level position, located above said first level position;

(C) said coolant vapor being cooled close to the saturation limit in a counterflow cooling system;

(D) said coolant vapor being liquified into a liquid coolant in at least one forced-draught type air cooler;

(E) said liquid coolant being driven through a pump wherein the pressure of said liquid coolant upon release from said air cooler is increased;

(F) said liquid coolant running through said counterflow cooling system; and (G) said liquid coolant flowing down to said first level position, wherein said liquid coolant drives a hydrualic turbine which is connected to a generator.

2. Method in accordance with claim 1, wherein said liquid coolant in the first level position is evaporated in a plurality of separate steps.

3. Method in accordance with claim 2, wherein the first of said plurality of separate steps utilizes water which is led towards the coolant through a heat exchanger.

4. Method in accordance with claim 2, wherein the second of said plurality of separate steps utilizes waste heat of a neighbouring power station.

5. Method in accordance with claim 2, wherein at least one of said plurality of of separate steps said liquid coolant is evaporated in the first level position by comparatively warm air which is led towards the coolant through a heat exchanger.

6. Method in accordance with one of the claim 1, wherein said second level position lies approximately 3000 m above the first level position.

7. Method in accordance with claim 1, wherein said liquid coolant impinges on at least one hydraulic turbine, in several fall tubes and subsequently is evaporated in the first level position.

8. Method in accordance with one of the claim 1, wherein said liquid coolant is a combination of $C_3H_8$ and $NH_3$.

9. Method in accordance with claim 8, wherein during the cold season $NH_3$ is eliminated from the coolant circuit.

10. Method in accordance with claim 8 characterized in that in the cold season $NH_3$ is eliminated from the coolant circuit.

11. The method of claim 1, wherein said liquid coolant is cooled further in a step-by-step cooling process after being released from said counterflow cooling system.

12. The method of claim 11, wherein said step-by-step cooling process provides working coolant vapor to drive turbines which are connected to said forced-draught type air cooler.

13. A system for power generation utilizing a coolant circuit comprising:

(A) at least one heat exchanger located in a first level position whereby a liquid coolant is evaporated into a coolant vapor;

(B) a long tube, oriented vertically, wherein said coolant vapor is allowed to rise to a second level position above said first level position;

(C) at least one condenser located at said second level position in which said coolant vapor is liquified into said liquid coolant;

(D) a plurality of fall tubes surrounding the outer circumference of said long tube;

(E) said fall tubes being connected to a hydraulic turbine of smaller diameter; and (F) said hydraulic turbine being connected to a generator for the production of power.

14. System in accordance with claim 13, wherein said heat exchanger is mounted in a river bed.

15. System in accordance with claim 13, wherein said heat exchanger utilizes waste heat of a neighboring power station or industrial plant.

16. The system of claim 13, wherein said long tube is approximately 3000 m in length and 20 in diameter.

17. The system of claim 16, wherein tubings for the dissipation of vaporized coolant are formed between said long tube and said plurality of fall tubes.

18. A system for power generation utilizing a coolant circuit comprising:

(A) at least one heat exchanger located in a first level position whereby a liquid coolant is evaporated into a coolant vapor;

(B) a long tube, oriented vertically, wherein said coolant vapor is allowed to rise to a second level position above said first level position;

(C) a platform mounted at said second level position;

(D) at least one counterflow cooling unit mounted on said platform wherein said coolant vapor is cooled;

(E) at least one condenser mounted on said platform wherein said coolant vapor is liquified into said liquid coolant after being cooled in said couterflow cooling unit;

(F) at least one fall tube connected to a hydraulic turbine of smalller diameter; and (G) said hydraulic turbine being connected to a generator for the production of power.

19. System in accordance with one of the claim 18, wherein said condenser is a forced-draught type air cooler being provided with a fan driven by at least one turbine.

20. System in accordance with claim 18, wherein said condenser is a wave-surface type air cooler.

21. System in accordance with one of the claim 18, wherein said long tube is clad with a heat shield.

22. System in accordance with one of the claim 18, wherein a plurality of condenser blocks are arranged on said platform.

23. The system of claim 18, wherein a pump provides an increase in pressure of said liquid coolant from said condenser prior to said liquid coolant being routed through said counterflow cooling unit.

24. The system of claim 18, wherin a plurality of containers are located on said platform whereby said liquid coolant is cooled in a step-by-step fashion as said coolant moves through said plurality of containers.

25. The system of claim 18, wherein a container is located after said container which allows for coolant vapor not liquified by said condenser to flow to a compressor located at said first level position, subsequently to a combined evaporator/condenser and subsequently to a storage reservoir.

26. The system of claim 25, wherein said coolant vapor not liquified by said condenser is $C_3H_8$.

27. The system of claim 25, wherein a second liquid coolant from a second reservoir is evaporated in said evaporator/condenser and is placed in said coolant circuit prior to the last of said at least one heat exchanger.

28. The system of claim 27, wherein said second liquid coolant is $NH_3$.

29. A system for power generation utilizing a coolant circuit comprising:

(A) at least one heat exchanger loacted in a first level position, whereby at least one liquid coolant is evaporated into a coolant vapor;

(B) a container where a first of said at least one liquid coolant which was not evaporated by said at least one heat exchanger emerges and is fed to a storage reservoir through the use of a pump;

(C) a second storage reservoir feeds a second of at least one liquid coolant through the use of a pump to said at least one heat exchanger;

(D) a long tube, oriented vertically, wherein said coolant vapor is allowed to rise to a second level position above said first level position;

(E) at least one condenser located at said second level position in which said coolant vapor is liquified into said liquid coolant;

(F) at least one fall tube connected to a hydraulic turbine of smaller diameter; and (G) said hydraulic turbine being connected to a generation for the production of power.

30. The system of claim 29, wherein the first of said at least one liquid coolant is $NH_3$, and the second of said at least one liquid coolant is $C_3$ H8.

31. A system for power generation utilizing a coolant circuit comprising:

(A) at least one heat exchanger located in a first level position whereby a liquid coolant is evaporated into a coolant vapor;

(B) a long tube, oriented vertically, wherein said coolant vapor is allowed to rise to a second level position above said first level position;

(C) at least one condenser located at said second level position in which said coolant vapor is liquified into said liquid coolant;

(D) a dynamic pressure wall pivotally mounted at approximately the second level position, and being held in the wind direction creates a dynamic pressure for improving to cooling effect;

(E) at least one fall tube connected to a hydraulic turbine of smalller diameter; and (F) said hydraulic turbine being connected to a generator for the production of power.

* * * * *

UNITED STATES PATENT AND TRADEMARK OFFICE

CERTIFICATE OF CORRECTION

PATENT NO. : 4,760,706

DATED : August 2, 1988

INVENTOR(S) : Gamal E. Nasser

It is certified that error appears in the above-identified patent and that said Letters Patent is hereby corrected as shown below:

Column 1, line 42, "wich" should be --which--.

Column 1, line 48, "convertred" should be --converted--.

Column 3, line 56, "reagion" should be --region--.

Column 9, line 23, "cold season $NH_3$" should be -- warm season $C_3H_8$--.

Column 12, line 10, "to" should be --the--.

Signed and Sealed this

Seventeenth Day of January, 1989

*Attest:*

DONALD J. QUIGG

*Attesting Officer*

*Commissioner of Patents and Trademarks*